US007770853B2

(12) United States Patent
Shiffler et al.

(10) Patent No.: US 7,770,853 B2
(45) Date of Patent: Aug. 10, 2010

(54) TWO PIECE SNAP-FIT CAP OR GLIDE

(75) Inventors: John W. Shiffler, Chardon, OH (US); William C. Rickard, Chardon, OH (US)

(73) Assignee: Shiffler Equipment Sales, Inc., Chardon, OH (US)

( * ) Notice: Subject to any disclaimer, the term of this patent is extended or adjusted under 35 U.S.C. 154(b) by 603 days.

(21) Appl. No.: 11/673,808

(22) Filed: Feb. 12, 2007

(65) Prior Publication Data

US 2008/0191106 A1 Aug. 14, 2008

(51) Int. Cl.
*F16M 11/20* (2006.01)

(52) U.S. Cl. ..... 248/188.9; 248/346.11

(58) Field of Classification Search ..... 248/188.8, 248/188.9, 346.11; 16/18 CG; 403/361, 403/344, 309

See application file for complete search history.

(56) References Cited

U.S. PATENT DOCUMENTS 4,035,095 A * 7/1977 Hughes, Jr. ..... 403/282
4,176,756 A * 12/1979 Gellman ..... 215/274
4,898,493 A * 2/1990 Blankenburg ..... 403/326
5,169,259 A * 12/1992 Cornell et al. ..... 403/309
5,170,528 A * 12/1992 Navar et al. ..... 16/18 CG
5,191,676 A * 3/1993 Gerner ..... 16/42 T
5,470,042 A * 11/1995 Fietz et al. ..... 248/678
5,536,068 A * 7/1996 Valentor et al. ..... 297/344.18
5,873,144 A * 2/1999 Tupper et al. ..... 16/18 CG
6,409,129 B1 * 6/2002 Chen et al. ..... 248/188.8
7,252,350 B2 * 8/2007 Chen et al. ..... 312/223.2

OTHER PUBLICATIONS

"New! Snap-N-Loc Glide Cap"; Glides and Casters, a Division of LCS Products, Inc., 4371 Northlake Blvd., Suite 367, Palm Beach Gardens, Florida 33410; 2006.

* cited by examiner

*Primary Examiner*—Korie Chan
(74) *Attorney, Agent, or Firm*—Rankin, Hill & Clark LLP

(57) ABSTRACT

A protective cap or furniture glide is provided that includes a main body and a secondary body. Each body has multiple protrusions and multiple openings such that the protrusions from the main body are inserted into the openings on the secondary body and the protrusions on the secondary body are inserted into the openings on the main body. The main body further includes a circular base that includes a removable material attached to the bottom.

20 Claims, 3 Drawing Sheets

TWO PIECE SNAP-FIT CAP OR GLIDE

FIELD OF THE INVENTION

The present invention relates to generally to furniture and more specifically to a two piece-protective cap or glide secured to a leg of the furniture.

BACKGROUND OF THE INVENTION

Protective caps or glides are well known in the art and address obvious problems associated with the moving or more specifically the sliding of furniture across a floor surface. For example, protective caps can decrease the difficulty in sliding furniture across a floor or a carpeted area by reducing the friction between the cap and the floor or carpeted area. Further, protective caps may be designed to decrease dirt and debris build up that becomes trapped on the bottom surface of the cap when sliding the furniture across the floor. Protective caps also protect the furniture from normal wear and tear due to sliding the furniture across the floor. These caps, however, are made of a material, such as nylon or polyethylene, known for its relatively high hardness to thereby provide durability. These caps were typically used on carpeted areas or hard surfaces such as, tile floors or older vinyl floors containing asbestos. Vinyl flooring manufactured today, however, does not contain asbestos and is therefore, softer and more prone to scratches than the tile floors or the older asbestos vinyl floors. The bottom surface of the aforementioned caps, thus, tends to scratch and damage the softer vinyl flooring.

Therefore, what is required is a protective cap or glide that overcomes the aforementioned disadvantage. More specifically, what is required is a protective cap or glide with a soft yet durable bottom surface that will not scratch or damage the floor surface.

SUMMARY OF THE INVENTION

In accordance with one aspect of the present invention a protective cap adapted to be secured to a bottom portion of a furniture leg is provided comprising a main body portion further comprising a first-connection portion, a first-connector-receiving portion located at each end of the connection portion, a first-connector portion located at each end of the first-connection portion and below each first-connector-receiving portion, each first-connector portion further including a first protrusion, a circular base portion, and a material removably attached to the bottom of the circular base portion, a secondary body portion further comprising a second-connection portion, a second-connector portion located at each end of the second-connection portion, each connector portion further including a second protrusion, and a second-connector-receiving portion located at each end of the second-connection portion and below each second-connector-receiving portion.

In accordance with another aspect of the present invention a furniture glide is provided comprising a main body portion further comprising, a curved-wall portion, an upper-rim portion, a lower-rim portion, and a semi-circular base portion, a channel and a first opening located at each end of the upper-rim portion, a first protrusion located at each end of the curved wall portion, each protrusion extending in a horizontal-outward direction such that the protrusions are generally parallel with each other, and a circular base portion, a material removably attached to the bottom of the circular base portion, a secondary body portion further comprising, a curved-wall portion, an upper-rim portion, a lower rim portion, and a semi-circular base portion, a second protrusion located at each end of the upper-rim portion, each protrusion extending in a substantially horizontal-outward direction such that the protrusions are generally parallel with each other, and a retaining projection and a second opening located in each end of the curved-wall portion, wherein the retaining projection is adjacent to the second opening and extends in a substantially horizontal direction such that the retaining projections are generally parallel with each other.

Additional benefits and advantages of the present invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings that form a part of the specification.

DETAILED DESCRIPTION OF THE INVENTION

Figure 10:
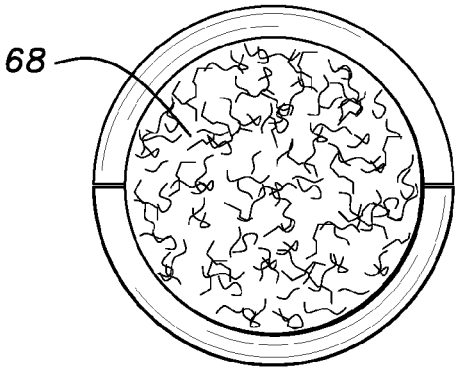
FIG. 10 is a bottom view of FIG. 1.
Figure 11:
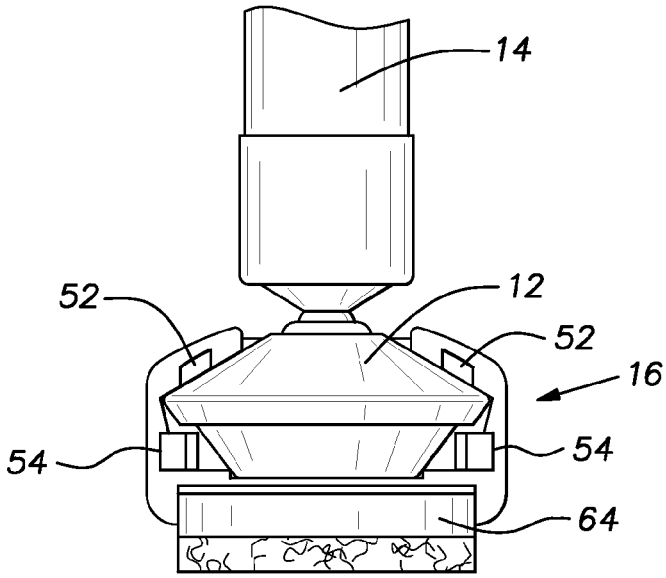
FIG. 11 is a front view of the main body portion with an attached furniture leg.

Referring now to the drawings, FIGS. 1-11 show a two-piece snap-fit cap 10 or glide (hereinafter "cap") in accordance with the present invention. The cap 10 attaches to a bottom portion 12 of a furniture leg 14, such a chair, a table, a desk or the like, as shown in FIG. 10. Thus, the cap 10 is disposed between the furniture leg 14 and a floor surface so as to facilitate movement of the furniture across the floor. Further, the cap 10 provides protection to both the bottom of the furniture leg and the floor.

Figure 1:
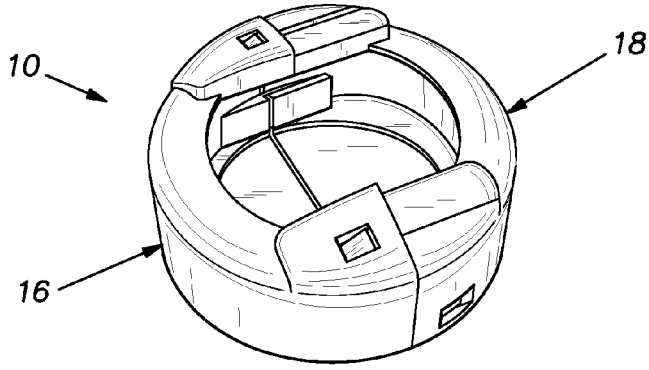
FIG. 1 is a perspective view showing the two piece snap-fit end cap or glide according to the present invention in an assembled condition.

Referring to FIGS. 1-3, the cap 10 is circular in shape and is made up a main-body portion 16 and a secondary-body portion 18. The main-body portion 16 is a single-integrated piece and is comprised of a first-connection portion 20 and a circular shaped base portion 22, as shown in FIG. 2. The first-connection portion 20 is semi circular in shape and further includes a curved-wall portion 24, an upper-rim portion 26, a lower-rim portion 28 and a semi-circular base 29, having a front edge 31. The curved-wall portion 24 further includes two ends 30, an upper portion 32 and a lower portion 34. The upper-rim portion 26 further includes two ends 36 and a top 38 and extends in a near horizontal direction from the upper portion 32 of the curved-wall portion 24. The lower-rim portion 28 extends in a substantially horizontal direction from the lower portion 34 of the curved-wall portion 24. The curved-wall portion 24, the upper 26 and lower 28 rim portions and the semi-circular base 29 form a first-receiving area 40 to receive the bottom portion 12 of the furniture leg 14.

Figure 2A:
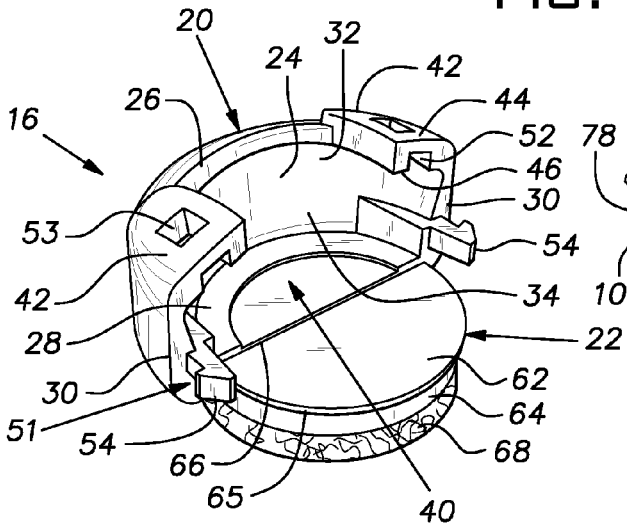
FIG. 2A is a perspective view of a main body portion of the two piece snap-fit end cap or glide.
Figure 2B:
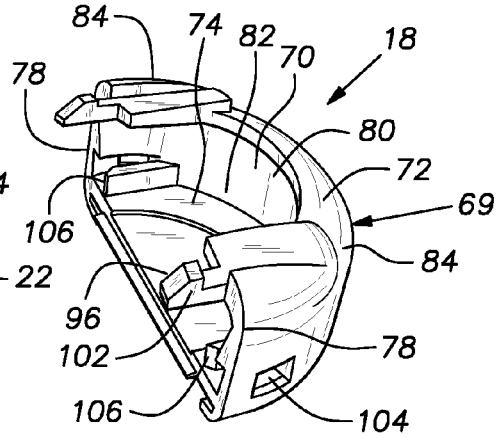
FIG. 2B is a perspective view of a secondary body portion of the two piece snap-fit end cap or glide.
Figure 3A:
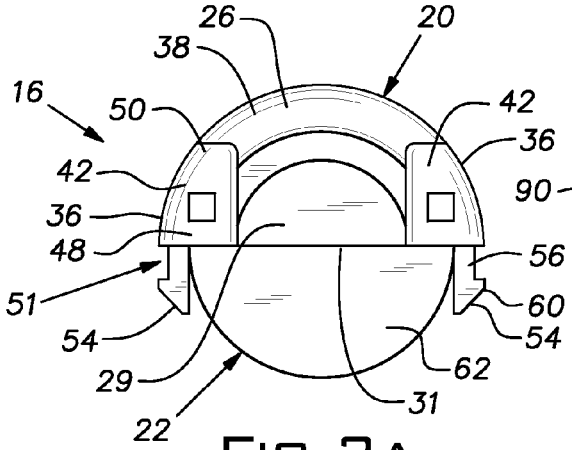
FIG. 3A is a top view of the main body portion.

Referring to FIGS. 2A and 3A, a first-connector-receiving portion 42 having a top 44, a bottom 46, a front 48 and a rear 50 is located at each end 36 of the upper-rim portion 26. The first-connector-receiving portion 42 has a thickness greater than the thickness of the upper-rim portion 26. Thus, the top 44 of the first-connector-receiving portion 42 extends slightly above the top 38 of the upper-rim portion 26, as best seen in FIG. 2. A channel 52 is formed in the bottom 46 of the first-connector-receiving portion 42 and extends approximately halfway from the front 48 of the first-connector-receiving portion 42 to the rear 50 of the first-connector-receiving portion 42. A first opening 53 is formed at an end of the channel 52 approximately halfway from the front 48 of the first-connector-receiving portion 42 to the rear 50 of the first-connector-receiving portion 42. The channel 52 and first opening 53 provide a connection point between the main-body portion 12 and the secondary-body portion 14 as will be described further below.

Located at the lower portion 34 of the curved-wall portion 24 and below each first-connector-receiving portion 42 is a first-connector portion 51 having a first protrusion 54. Each first protrusion 54 extends in a substantially horizontal-outward direction from each end 30 of the curved-wall portion 24 such that the first protrusions 54 are generally parallel with each other. Each first protrusion 54 further includes an arm 56 and a latching portion 60, which is located at the distal end of the arm 56. The latching portion 60 extends in a horizontal direction such that the latching portions 60 on each first protrusion 54 extend away from each other. The first protrusions 54 provide a connection point between the main-body portion 16 and the secondary-body portion 18 as will be described further below.

The circular-base portion 22 comprises a top surface 62 and a bottom-support portion 64. The diameter of the top surface 62 extends slightly beyond the diameter of the bottom-support portion 64 thereby forming a lip 65 around the circumference of circular-base portion 22. The semi-circular base 29 of the first-connection portion 20 interfaces with the top surface 62 of the circular-base portion 22 to thereby form the integrated main-body portion 16. A recess 66 is formed between the front edge 31 of the semi-circular base 29 and the circular-base portion 22 to receive a portion of the secondary-body portion 18 as will be described further below.

Attached to the bottom-support portion 64 of the circular-base portion 22 is a removable material 68 that enables the furniture to easily slide across the floor surface. The removable material 68 may be attached to the bottom-support portion 64 by any means known in the art, such as, but not limited to gluing and may be comprised of any material known in the art, such as, but not limited to felt.

Figure 3B:
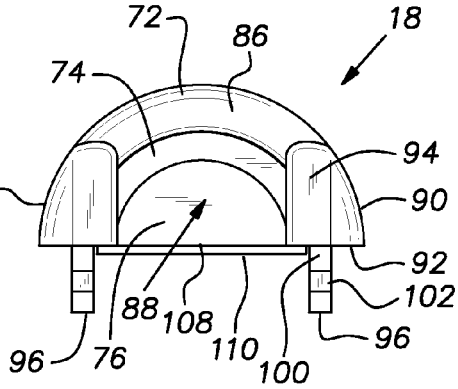
FIG. 3B is a top view of the secondary body portion.
Figure 5:
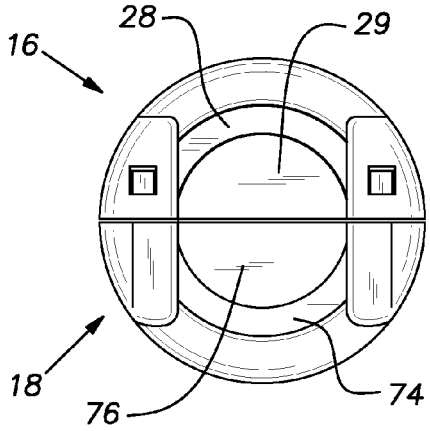
FIG. 5 is a top plan view of FIG. 1.

Referring to FIGS. 2B and 3B, the secondary-body portion 18 is semi circular in shape and comprises a second-connection portion 69 having a curved-wall portion 70, an upper-rim portion 72, a lower-rim portion 74 and a semi-circular base 76. The curved-wall portion 70 further includes two ends 78, an upper portion 80 and a lower portion 82. The upper-rim portion 72 includes two ends 84 and a top 86 and extends in a near horizontal direction from the upper portion 80 of the curved-wall portion 70. The lower-rim portion 74 extends in a substantially horizontal direction from the lower portion 82 of the curved-wall portion 70. The curved-wall portion 70, the upper 72 and lower 74 rim portions and the semi-circular base 76 form a second-receiving area 88 that cooperates with the first-receiving area 40 to thereby surround the bottom portion 12 of the furniture leg 14.

A second-connector portion 90 is located at each end 84 of the upper-rim portion 72 and has a front 92 and a top 94. The second-connector portion 90 has a thickness greater than the thickness of the upper-rim portion 72. Thus, the top 94 of the second-connector portion 90 extends slightly above the top 86 of the upper-rim portion 72. A second 96 protrusion extends in a substantially horizontal-outward direction from the front 92 of each second-connector portion 90 such that the second protrusions 96 are generally parallel with each other. Each second protrusion 96 further includes an arm 100 and a latching portion 102, which is located at the distal end of the arm 100. The latching portion 102 extends in an upward vertical direction from the arm 100.

A second opening 104 is formed in each end 78 of the curved-wall portion 70 and below each second-connector portion 90. A retaining projection 106 is adjacent to each second opening 104. Each retaining projection 106 is attached to the lower portion 82 of the curved-wall portion 70 and extend in a substantially horizontal direction toward the main-body portion 16 in such a manner that the retaining projections 106 are generally parallel with each other. The second openings 104 and retaining projections 106 form a second-connector-receiving portion between the main-body portion 16 and the secondary-body portion 18 as will be described further below.

At a front edge 108 of the semi-circular base 76 is a lip 110. The lip 110 has a thickness less than that of the semi-circular base 76. Thus, when the main-body portion 16 and the secondary-body portion 18 are connected the lip 110 slides under the semi-circular base 29 of the circular base portion 22 and into the recess 66 formed between the front edge 31 of the semi-circular base 29 and the circular-base portion 22 of the main-body portion 16.

Figure 4:
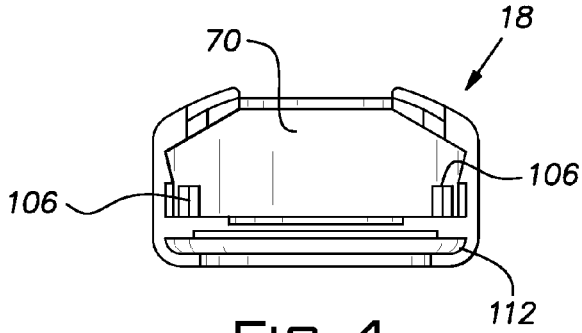
FIG. 4 is a front elevation view of FIG. 3B.
Figure 6:
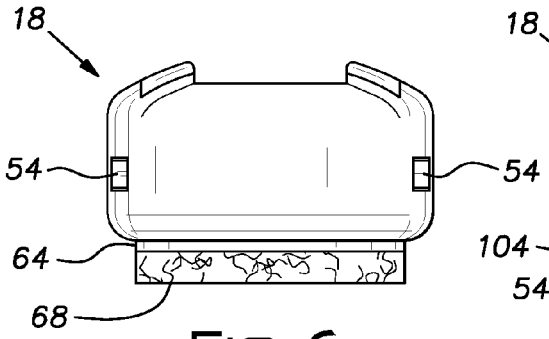
FIG. 6 is a front elevation view of FIG. 1.
Figure 7:
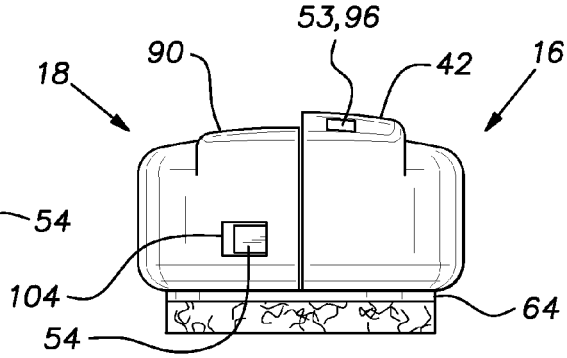
FIG. 7 is a right side elevation view of FIG. 1.
Figure 8:
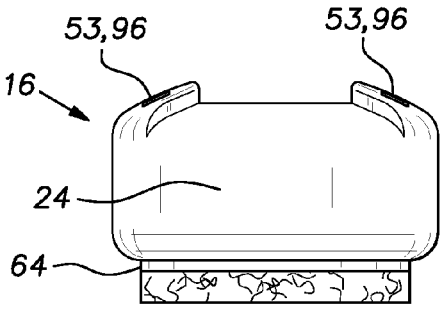
FIG. 8 is a rear elevation view of FIG. 1.
Figure 9:
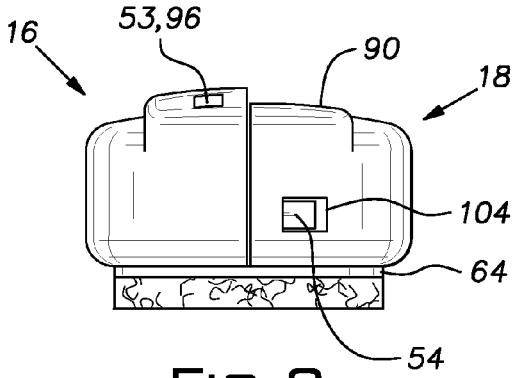
FIG. 9 is a left side view of FIG. 1.

As shown in FIG. 3B and FIG. 4, the lower-rim portion 74 extends below the semi-circular base 76 such that a semi-circular recess 112 is formed below the semi-circular base 76 between the lower-rim portion 74 and the semi-circular base 76. Thus, when the main-body portion 16 and the secondary-body portion 18 are connected the lip 65 on the circular-base portion 22 is inserted into the semi-circular recess 112.

To attach the cap 10 to the furniture leg 14, the bottom portion 12 of the furniture leg 14 is first inserted into the receiving area 40 of the main-body portion 16. The secondary-body portion 18 is then placed around the bottom portion 12 of the furniture leg 14 such that the exposed portion of the bottom portion 12 is placed into the second receiving area 88. The main-body portion 16 and the secondary-body portion 18 are attached to each other such that the first 54 protrusions on the main-body portion 16 are inserted between the curved-wall portion 70 and the retaining projection 106 on the secondary-body portion 18. The retaining projections 106 force the latching portion 60 into the second openings 104 thereby preventing the protrusions 54 from becoming disengaged from the second openings 104. Further, the second protrusions 96 on the secondary-body portion 18 are inserted into the channel 52 on the main-body portion 16 such that the latching portion 102 engages the first openings 53 on the main-body portion 16. When the latching portions 60, 102 are secured into their respective openings 104, 53 the main-body portion 16 and the secondary-body portion 18 is securely attached around the bottom portion 12 of the furniture leg 14 thereby providing protection to the furniture leg and the floor surface.

The connection described above secures the main-body portion 16 and the secondary-body portion 18 to each other in such a manner that the two portions 16, 18 resist separation from one another in both the horizontal plane and the vertical plane. This resistance to separation prevents the main-body portion 16 and the secondary-body portion 18 from rotating in opposite directions along a horizontal axis. Thus, the cap 10 cannot be separated due to inadvertent or accidental twisting of the main-body portion 16 in one direction and the secondary-body portion 18 in an opposite direction.

While specific embodiments of the invention have been described and illustrated it is to be understood that these embodiments are provided by way of example only and that the invention is not to be construed as being limited but only by proper scope of the following claims.

What is claimed is:

1. A protective cap adapted to be secured to a bottom portion of a furniture leg comprising:

a main body portion further comprising:

a first-connector-receiving portion;

a first-connector portion located below the first-connector-receiving portion; and a circular base portion;

a secondary body portion further comprising:

a second-connector portion; and, a second-connector-receiving portion located below the second-connector portion;

wherein the main body portion further comprises:

a first-connection portion, wherein the first-connector-receiving portion and first-connector portion are located at each end of the first-connection portion and wherein each first-connector portion includes a first protrusion; and a material removably attached to the bottom of the circular base portion; and wherein the secondary body portion further comprises:

a second-connection portion, wherein the second-connector portion and second-connector-receiving portion are located at each end of the second-connection portion, and wherein each connector portion includes a second protrusion.

2. The protective cap of claim 1, wherein the first-connector-receiving portion comprises a channel and a first opening, wherein the first opening is located at an end of the channel, wherein the second-connector-receiving portion comprises a retaining projection and a second opening, and wherein the retaining projection is adjacent to the second opening.

3. The protective cap of claim 2, wherein the first-connector-receiving portion comprises a top, a bottom, a front and a rear, wherein the channel is located in the bottom of the first-receiving-connector portion and extends approximately halfway from the front of the first-connector-receiving portion to the rear of the first-connector-receiving portion.

4. The protective cap of claim 3, wherein the first-connection portion further comprises:

a curved-wall portion having two ends, an upper portion, and a lower portion;

an upper-rim portion having two ends and a top, the upper rim portion extending in a near horizontal direction from the upper portion of the curved-wall portion;

a lower rim portion extending in a substantially horizontal direction from the lower portion of the curved-wall portion; and, a semi-circular base, wherein the curved-wall portion, the upper-rim portion, the lower-rim portion and the semi-circular base form a first receiving area.

5. The protective cap of claim 4, wherein the first-connector-receiving portion is located at each end of the upper rim portion of the first connection portion and wherein the thickness of the first-connector-receiving portion is greater than the thickness of the upper-rim portion, and wherein the top of the first-connector-receiving portion extends slightly above the top of the upper-rim portion.

6. The protective cap of claim 5, wherein the second-connection portion further comprises:

a curved-wall portion having two ends, an upper portion and a lower portion;

an upper-rim portion having two ends and a top, the upper-rim portion extending in a near horizontal direction front the upper portion of the curved-wall portion;

a lower rim portion extending in a substantially horizontal direction from the lower portion of the curved-wall portion; and, a semi-circular base, wherein the curved-wall portion, the upper-rim portion, the lower-rim portion and the semi-circular base form a second receiving area.

7. The protective cap of claim 6, wherein the second-connector portion is located at each end of the upper rim portion of the second-connection portion, wherein the thickness of the second-connector portion is greater than the thickness of the upper-rim portion, and wherein the top of the second-connector portion extends slightly above the top of the upper-rim portion.

8. The protective cap of claim 7, wherein the first receiving area cooperates with the second receiving area to thereby surround the bottom portion of the furniture leg.

9. The protective cap of claim 2, wherein the first protrusion extends in a substantially horizontal-outward direction, and wherein the second protrusion extends in a substantially horizontal-outward direction.

10. The protective cap of claim 9, wherein the first protrusion further includes an arm and a latching portion, where the latching portion is located at a distal end of the arm, such that the latching portion extends in a direction away from the center of the cap, and wherein the second protrusion further includes an arm and a latching portion, where the latching portion is located at the distal end of the arm such that the latching portion extends in an upward direction.

11. The protective cap of claim 10, wherein the first protrusion is inserted into the second-connector-receiving portion and the second protrusion is inserted into the first-connector-receiving portion when the protective cap is secured to the bottom portion of the furniture leg.

12. The protective cap of claim 11, wherein the latching portion of the first protrusion engages the second opening in the secondary-body portion and the second protrusion engages the first opening in the main-body portion when the protective cap is secured to the bottom portion of the furniture leg.

13. The protective cap of claim 1, wherein the circular-base portion of the main body portion further includes a top surface and a bottom-support portion, wherein the top surface has a diameter slightly larger than the diameter of the bottom-support portion such that a lip is formed around the circumference of the circular-base portion.

14. The protective cap of claim 13, wherein the secondary-body portion includes a semi-circular base and a lower rim portion extending below the semi-circular base such that a semi-circular recess is formed in the lower-rim portion below the semi-circular base, wherein when the main-body portion and the secondary-body portion are connected the lip on the circular-base portion is inserted into the recess formed in the lower-rim portion.

15. The protective cap of claim 14, wherein the top surface of the circular-base portion interfaces with a semi-circular base of the first-connection portion, and wherein a recess is formed between a front edge of the semi-circular base and the top surface of the circular-base portion.

16. The protective cap of claim 15, wherein the semi-circular base of the secondary-body portion further includes a lip formed at a front edge, and wherein when the main-body portion and the secondary-body portion are connected the lip of the semi-circular base on the secondary-body portion is inserted into the recess formed between the front edge of the semi-circular base and the top surface of the circular-base portion.

17. A furniture glide comprising:

a main body portion further comprising:

a curved-wall portion, an upper-rim portion, a lower-rim portion, and a semi-circular base portion;

a channel and a first opening located at each end of the upper-rim portion;

a first protrusion located at each end of the curved wall portion, each protrusion extending in a horizontal-outward direction such that the protrusions are generally parallel with each other; and, a circular base portion;

a material removably attached to the bottom of the circular base portion;

a secondary body portion further comprising:

a curved-wall portion, an upper-rim portion, a lower rim portion, and a semi-circular base portion;

a second protrusion located at each end of the upper-rim portion, each protrusion extending in a substantially horizontal-outward direction such that the protrusions are generally parallel with each other; and, a retaining projection and a second opening located in each end of the curved-wall portion, wherein the retaining projection is adjacent to the second opening and extends in a substantially horizontal direction such that the retaining projections are generally parallel with each other.

18. The furniture glide of claim 17, wherein each first protrusion further includes an arm and a latching portion, where the latching portion is located at a distal end of the arm, such that the latching portions extend in a direction away from each other, and wherein each second protrusion further includes an arm and a latching portion, where the latching portion is located at the distal end of the arm such that the latching portions extend in an upward direction.

19. The furniture glide of claim 18, wherein the latching portion of each first protrusion engages the second opening in the secondary-body portion and each latching portion of the second protrusion engages the first opening in the main-body portion when the protective cap is secured to the bottom portion of the furniture leg.

20. The furniture glide of claim 19, wherein the circular-base portion of the main body portion further includes a top surface and a bottom-support portion, wherein the top surface has a diameter slightly larger than the diameter of the bottom-support portion such that a lip is formed around the circumference of the circular-base portion, wherein the secondary-body portion includes a semi-circular base and a lower rim portion extending below the semi-circular base such that a semi-circular recess is formed in the lower-rim portion below the semi-circular base, and wherein when the main-body portion and the secondary-body portion are connected the lip on the circular-base portion is inserted into the recess formed in the lower-rim portion.

* * * * *